US006598252B2

(12) United States Patent
Woerlee

(10) Patent No.: US 6,598,252 B2
(45) Date of Patent: Jul. 29, 2003

(54) DISSOLVING DEVICE AND METHOD FOR DISSOLVING A PARTICULATE SOLID IN A SUPERCRITICAL OR ALMOST CRITICAL FLUID AND DYEING DEVICE

(75) Inventor: Geert Feye Woerlee, Amsterdam (NL)

(73) Assignee: Stork Prints B.V., Boxmeer (NL)

( * ) Notice: Subject to any disclaimer, the term of this patent is extended or adjusted under 35 U.S.C. 154(b) by 180 days.

(21) Appl. No.: 09/847,022

(22) Filed: May 1, 2001

(65) Prior Publication Data

US 2001/0051124 A1 Dec. 13, 2001

(30) Foreign Application Priority Data

May 2, 2000 (NL) ..... 1015085

(51) Int. Cl.[7] ..... D06F 39/08
(52) U.S. Cl. ..... 8/158; 68/17 R; 68/207
(58) Field of Search ..... 8/158, 159; 68/17 R, 68/207, 18 R; 134/93; 137/268

(56) References Cited

U.S. PATENT DOCUMENTS 5,958,085 A 9/1999 Eggers et al.

FOREIGN PATENT DOCUMENTS

EP 0850682 A1 7/1998
JP 5-277430 * 10/1993
JP 7-313896 * 12/1995
WO WO 95/03120 2/1995
WO WO 97/14843 4/1997

OTHER PUBLICATIONS

International Search Report, Stork Brabant B.V., Dec. 20, 2000.

Translation of Search Report, Stork Brabant B.V., Dec. 20, 2000.

* cited by examiner

*Primary Examiner*—Frankie L. Stinson
(74) *Attorney, Agent, or Firm*—Troutman Sanders LLP; Ryan A. Schneider, Esq.

(57) ABSTRACT

A dissolving device for dissolving a particulate solid in a supercritical or almost critical fluid comprises a circulation loop, in which there is a feed for feeding a feed stream of the supercritical or almost critical fluid, a cyclone, which is in communication with the feed and has a principal discharge for discharging a principal discharge stream of a solution of the particulate solid in the supercritical or almost critical fluid and has an auxiliary discharge for discharging an auxiliary stream of the supercritical or almost critical fluid with solid particles dispersed therein, the auxiliary discharge being in communication with the said feed. A dissolving device of this type has a low pressure drop and a high dissolving rate compared to the prior art.

8 Claims, 1 Drawing Sheet

DISSOLVING DEVICE AND METHOD FOR DISSOLVING A PARTICULATE SOLID IN A SUPERCRITICAL OR ALMOST CRITICAL FLUID AND DYEING DEVICE

CROSS-REFERENCE TO RELATED APPLICATIONS AND CLAIM OF PRIORITY

The present application claims the benefit of foreign priority on Netherlands application 1015085, filed May 2, 2000.

FIELD OF THE INVENTION

The present invention relates to a dissolving device and method for dissolving a particulate solid in a stream of a supercritical or almost critical fluid.

BACKGROUND OF THE INVENTION

A dissolving device of this type is known, for example, from international patent application WO 97/14843, which describes a method for dyeing a textile substrate in a supercritical fluid, such as $CO_2$, in which a dye is dissolved. In order to dissolve a particulate dye in the fluid, this dye is placed in a dye container, for example as a fixed bed or fluidized bed between perforated plates, through which a stream of the supercritical fluid is passed. A solution of dye and supercritical fluid which is formed in this way is then passed over and through the textile substrate which is to be dyed, the dye being deposited on the substrate. The substrate is situated in a pressure vessel which, together with the dye container and other necessary components such as a circulation pump, is accommodated in a loop of lines.

In practice, however, it has been found that with this design of the dye container and under the pressure and temperature conditions used, sintering of the dye may occur, which reduces the solubility of the dye in the supercritical fluid. Furthermore, it is necessary to prevent the fluid stream from containing dye particles of relatively large dimensions (for example particles of 30 micrometers and larger), since these dye particles become deposited on the substrate and reduce the evenness of and cause dye spots on the substrate. To this end, the abovementioned perforated plates also function as filters.

Furthermore, the conventional dyeing containers have the significant drawback that flow through these containers causes a high pressure drop. This pressure drop limits the amount of supercritical fluid which can be pumped through the dyeing container. However, since the quantity of supercritical fluid per unit time is partially responsible for determining the dissolution rate and therefore the rate of the dyeing process, this represents a significant restriction. In practice, this restriction can be overcome by installing a pump with a high working head. Another possibility for eliminating this restriction is the use of a dyeing container of significantly larger dimensions. However, both the solutions described above entail additional costs.

Thus there is a need to provide a dissolving device for dissolving a particulate solid in a supercritical or almost critical fluid in which the pressure drop across the dissolving device is low and in which scarcely any undissolved solid particles are entrained in the fluid stream.

SUMMARY OF THE INVENTION

According to the invention, to this end the dissolving device comprises a circulation loop, comprising a feed for feeding a feed stream of the supercritical or almost critical fluid, a cyclone, which is in communication with the feed and has a principal discharge for discharging a principal discharge stream of a solution of the particulate solid in the supercritical or almost critical fluid and has an auxiliary discharge for discharging an auxiliary stream of the supercritical or almost critical fluid with solid particles dispersed therein, the auxiliary discharge being in communication with the said feed.

In the dissolving device according to the invention, the particulate solid which is to be dissolved is introduced into a circulation loop in which a cyclone is incorporated. In the turbulent flow in the cyclone, the solid particles are brought into intimate contact with the supercritical or almost critical fluid. In the cyclone, the undissolved solid particles are flung outwards by the centrifugal force and are discharged at the bottom of the cyclone via the auxiliary discharge (as is known, particles are separated according to mass in a cyclone). The principal discharge stream, which is discharged at the top of the cyclone, comprises a solution of the solid particles in the supercritical or almost critical fluid. The auxiliary stream of supercritical or almost critical fluid containing dispersed solid particles is introduced back into the feed stream of the cyclone, so that the solid particles continue to circulate until they have been sufficiently dissolved. When using a cyclone to dissolve a particulate solid in a supercritical or almost critical fluid, the pressure drop is low compared to the (dyeing) containers for dye particles according to the prior art. When using the dissolving device according to the invention in a dyeing method with a solution of dye in a supercritical or almost critical fluid, it is thus possible for this dyeing process to be carried out more quickly. Moreover, there is no need for additional investment costs on pumps with a high working head and/or dyeing containers of large dimensions, which leads to lower costs.

The dissolving device according to the invention does not have to contain additional filters, since the cyclone itself may be designed and operated in such a manner that separation according to the desired particle dimensions/mass takes place therein. An additional pressure drop caused by the filters in the devices according to the prior art, such as the perforated plates described above, is thus avoided.

BRIEF DESCRIPTION OF THE DRAWINGS

The invention is explained below with reference to the only FIGURE, which diagrammatically depicts an embodiment of a dyeing device according to the invention which also comprises a dissolving device according to the invention.

DESCRIPTION OF THE PREFERRED EMBODIMENT

Figure 1:
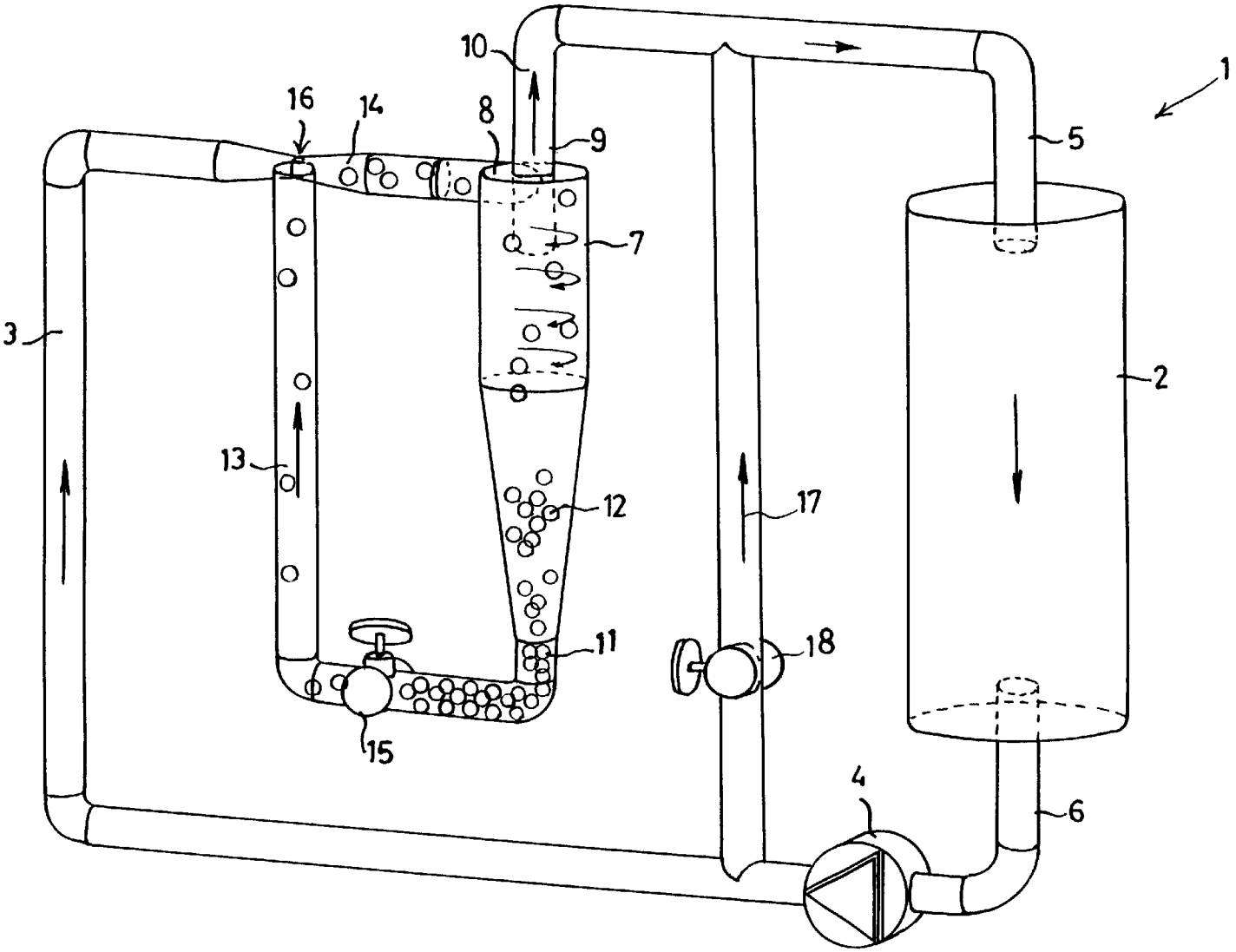

As has already been stated above, the solid particles are kept in the circulating stream of the supercritical or almost critical fluid until they have been dissolved to the desired extent. In order to bring about and maintain this circulating stream through the cyclone in a simple manner, pump means for effecting a circulating flow in the circulation loop of the fluid containing dispersed solid particles, for example a mechanical pump, may be incorporated in the circulation loop. However, the pump means preferably comprise a Venturi connection which connects the auxiliary discharge and the feed to one another. In a connection of this type, the auxiliary stream of supercritical or almost critical fluid with solid particles dispersed therein is drawn into the cyclone by the feed stream, so that there is no need for further pumps in this circulation loop. This makes the supply to the cyclone self-regulating. Moreover, the forced flow in the cyclone and the circulation loop prevents the solid particles from forming agglomerates which, on account of their larger dimensions, have a lower dissolution rate.

The present invention also relates to a dyeing device for dyeing a substrate with a dye which is dissolved in a stream of supercritical or almost critical fluid, which dyeing device comprises a principal line system with a dyeing vessel for accommodating the substrate to be dyed, and a dissolving device for dissolving a particulate dye according to the invention, the entry to the dyeing vessel being connected to the principal discharge of the cyclone and the discharge of the dyeing vessel being connected to the feed of the dissolving device. With the dyeing device according to the invention, the abovementioned advantages of the dissolving device according to the invention are achieved, and dye spots on the substrate caused by the presence of excessively large dye particles in the principal discharge stream are also prevented.

In general, one or more circulation pumps will be arranged in the principal line system of the dyeing device. The circulation pump is advantageously arranged downstream of the dyeing vessel and upstream of the dissolving device. When using the dyeing device, after this device has been brought to the pressure and temperature which are required for the dyeing process, one circulation pump in the principal line system is generally sufficient to make the supercritical fluid pass through the circulation loop with the cyclone and through the principal line system with the dyeing vessel.

Advantageously, in the dyeing device according to the invention the discharge of the dyeing vessel is in communication, via a branch with a nonreturn restrictor valve, with the feed of the dyeing vessel. Since the dissolved dye is deposited on the substrate in the dyeing vessel, the concentration of the dye in the fluid stream downstream of the dyeing vessel is virtually zero, so that if a branch of this type is present, parallel to the dyeing vessel, the last dye particles which have not been trapped by the cyclone (for example particles of 10 micrometers and less) can still dissolve, since the equilibrium concentration of the dye in the principal discharge stream shifts as a result of the fluid stream admitted via the branch. It should be noted that in the dyeing containers according to the prior art, these relatively small particles often give rise to an additional pressure drop, since a packed bed becomes less porous and filters become blocked.

The invention also relates to a method for dissolving a particulate solid, in particular a dye, in a supercritical or almost critical fluid, which method comprises at least the step a) of bringing the particulate solid into contact with a stream of the supercritical or almost critical fluid, in which method, according to the invention, step a) is carried out in a dissolving device according to the invention, advantageously in such a manner that solid particles with dimensions of greater than 15 micrometers are substantially kept in the circulation loop of the dissolving device. It has been found that dye particles of less than 15 micrometers do not have any adverse effect on the dyeing process and the quality of the dyed substrate.

The supercritical or almost critical fluid used may, inter alia, be $CO_2$, $N_2O$, lower alkanes and mixtures thereof. Examples of lower alkanes are ethane and propane. In practice, the explosion limits and toxicity values also play an important role in determining the composition of the fluid.

The dyeing conditions for the dyeing method according to the invention are selected on the basis of the textile substrate which is to be dyed and the dye employed. The temperature generally lies in the range from 20–220° C. preferably 90–150° C. The pressure which is applied during the dyeing must be at least high enough for the fluid to be in the supercritical or almost critical state at the prevailing temperature. The pressure usually lies in the range from $5.10^6$–$5.10^7$ Pa (50–500 bar), more preferably between $2.10^7$–$3.10^7$ Pa (200 to 300 bar). As non-limiting examples, it is possible to mention a temperature of approximately 140° C. and a pressure of approximately $2.5.10^7$ Pa (250 bar) for dyeing cotton, while for polyester a temperature of approximately 120° C. and a pressure of approximately $2.8.10^7$ Pa (280 bar) is preferred, and for wool a temperature of approximately 110° C. and a pressure of approximately $2.5.10^7$ Pa (250 bar) is preferred. It will be understood that the dissolving device according to the invention will be designed and constructed in such a manner that this device is able to withstand the pressure and temperature conditions of the supercritical or almost critical fluid employed.

The pressure-and temperature-resistant dyeing device illustrated, which is denoted overall by reference number 1, comprises a dyeing vessel 2, in which a textile substrate (not shown) which is to be dyed is accommodated. This dyeing vessel 2 forms part of a principal line system 3, in which a supercritical fluid, such as $CO_2$, is circulated with the aid of a circulation pump 4. This circulation pump 4 is arranged on the discharge side of the dyeing vessel 2. In the embodiment illustrated, the principal line system 3 comprises a feed line 5 to the dyeing vessel 2, and a discharge line 6 from the dyeing vessel 2, in which the circulation pump 4 is incorporated. A dissolving device according to the invention is incorporated in the feed line 5. This dissolving device comprises a cyclone 7 which, as is customary, is provided in the vicinity of its top side with a tangential inlet 8 for feeding the supercritical fluid (containing dispersed solid particles as will become clear below) to the cyclone 7. A central principal discharge 9 for discharging a principal discharge stream of a solution of the particulate solid in the supercritical or almost critical fluid is at the top of the cyclone 7, which principal discharge 9 is in communication with a line section 10 of the feed line 5 leading to the dyeing vessel 2. The bottom of the cyclone 7 has an auxiliary discharge 11 for discharging an auxiliary stream of supercritical or almost critical fluid with solid particles dispersed therein. The solid particles are illustrated as small spheres and are denoted by reference numeral 12. Solid particles which have not been dissolved in the fluid are deposited in the cyclone 7 and collect in the auxiliary discharge 11 and are carried along by the auxiliary stream via the line 13 which is in communication with a line section 14 of the feed line 5. A ball valve 15 for regulating the flow is incorporated between the auxiliary discharge 11 and the line 13. The connection between (discharge) line 13 of the cyclone 7 and the (feed) line section 14 of the cyclone comprises a Venturi 16, so that no further pumps are required here. Furthermore, there is a branch line 17 with nonreturn valve 18 which is arranged parallel to the dyeing vessel 2.

The device operates as follows.

The substrate which is to be dyed is introduced into the dyeing vessel 2, and the dye to be used is accommodated, for example, downstream of the cyclone 7, beneath the auxiliary discharge 11, in the circulation loop comprising cyclone 7, valve 15, line 13 and line section 14. A supercritical fluid is introduced into the principal line system 3 from a source for the supercritical fluid (not shown), and the entire system is brought to a predetermined temperature and pressure, after which the connection to the source (not shown) is closed. The circulation pump 4 is activated, with the result that the supercritical fluid begins to circulate through the principal line system 3. The dye particles 12 are entrained by the auxiliary stream of supercritical fluid into line 13 and introduced into the principal stream of supercritical fluid in line section 14 and further into the cyclone 7 via the inlet 8. During this transport of the solid particles 12, these particles are dissolved in the fluid, a process which continues in the cyclone 7. Particles which have not dissolved are separated out in the cyclone and discharged via the auxiliary discharge 11, thus being kept in circulation. A principal stream of a solution of supercritical fluid with solid particles dissolved therein leaves the cyclone 7 via the principal discharge 9, and this principal stream is fed via line section 10 to the pressure vessel 2. The dissolved dye is deposited on the substrate, so that an unsaturated stream of supercritical fluid (i.e. concentration of dye is approximately 0) is discharged from the dyeing vessel 2 via discharge line 6. A partial stream of this discharge stream from the dyeing vessel is returned, via the branch line 17, to the line section 10 and thus back to the dyeing vessel, so that small solid particles which have not been separated out in the cyclone 7 still have an opportunity to dissolve in the additional quantity of supercritical fluid which is fed via this branch line 17. However, the majority of the discharge stream from the dyeing vessel 2 is returned to the Venturi connection 16, so that the auxiliary stream is sucked out of the line 13 and in this way the circulation in the dissolving device of the dyeing device 1 is maintained. When the dyeing process has progressed sufficiently, the temperature is reduced and the pressure relieved, for which purpose the dyeing device is provided with suitable outlet points (not shown).

The use of a cyclone when dissolving the dye increases the dissolution rate and brings about expedient separation of agglomerated dye particles or other large dye particles, so that the substrate to be dyed has an even colour without spots.

What is claimed is:

1. Dissolving device for dissolving a particulate solid in a stream of supercritical or almost critical fluid, comprising a circulation loop, comprising a feed for feeding a feed stream of the supercritical or almost critical fluid, a cyclone, which is in communication with the feed and has a principal discharge for discharging a principal discharge stream of a solution of the particulate solid in the supercritical or almost critical fluid and has an auxiliary discharge for discharging an auxiliary stream of the supercritical or almost critical fluid with solid particles dispersed therein, the auxiliary discharge being in communication with the said feed.

2. Dissolving device according to claim 1, comprising pump means for effecting a circulating flow of the fluid containing dispersed solid particles in the circulation loop.

3. Dissolving device according to claim 2, wherein the pump means comprise a venturi connection which connects the auxiliary discharge to the feed.

4. Dyeing device for dyeing a substrate with a dye which is dissolved in a stream of supercritical or almost critical fluid, comprising a principal line system with a dyeing vessel for accommodating the substrate to be dyed, and a dissolving device for dissolving a particulate dye in a supercritical or almost critical fluid, comprising a circulation loop, comprising a feed for feeding a feed stream of the supercritical or almost critical fluid, a cyclone, which is in communication with the feed and has a principal discharge for discharging a principal discharge stream of a solution of the particulate solid in the supercritical or almost critical fluid and has an auxiliary discharge for discharging an auxiliary stream of the supercritical or almost critical fluid with solid particles dispersed therein, the auxiliary discharge being in communication with the said feed, the entry to the dyeing vessel being connected to the principal discharge of the cyclone, and the discharge of the dyeing vessel being connected to the feed of the dissolving device.

5. Dyeing device according to claim 4, wherein a circulation pump is arranged in the principal line system, downstream of the dyeing vessel and upstream of the dissolving device.

6. Dyeing device according to claim 4, wherein the discharge of the dyeing vessel is in communication, via a branch line with a nonreturn restrictor valve, with the feed of the dyeing vessel.

7. Method for dissolving a particulate solid, in particular a dye, in a supercritical or almost critical fluid, comprising at least the step a) of bringing the particulate solid into contact with a stream of the supercritical or almost critical fluid, wherein step a) is carried out in a dissolving device for dissolving a particulate solid in a stream of supercritical or almost critical fluid, comprising a circulation loop, comprising a feed for feeding a feed stream of the supercritical or almost critical fluid, a cyclone, which is in communication with the feed and has a principal discharge for discharging a principal discharge stream of a solution of the particulate solid in the supercritical or almost critical fluid and has an auxiliary discharge for discharging an auxiliary stream of the supercritical or almost critical fluid with solid particles dispersed therein, the auxiliary discharge being in communication with the said feed, in such a manner that solid particles with dimensions of larger than 15 micrometers are substantially kept in the circulation loop.

8. Method according to claim 7, characterized in that the fluid is selected from $CO_2$, $N_2O$, lower alkanes, and mixtures thereof.

* * * * *